US010998643B2

(12) United States Patent
Yang

(10) Patent No.: US 10,998,643 B2
(45) Date of Patent: May 4, 2021

(54) SIGNAL INTEGRATED TERMINAL

(71) Applicant: Shenzhen Antop Technology Limited, Shenzhen (CN)

(72) Inventor: Ruidian Yang, Shenzhen (CN)

(73) Assignee: SHENZHEN ANTOP TECHNOLOGY LIMITED, Shenzhen (CN)

( * ) Notice: Subject to any disclaimer, the term of this patent is extended or adjusted under 35 U.S.C. 154(b) by 31 days.

(21) Appl. No.: 16/040,867

(22) Filed: Jul. 20, 2018

(65) Prior Publication Data

US 2019/0173174 A1 Jun. 6, 2019

(30) Foreign Application Priority Data

Dec. 5, 2017 (CN) ..... 201721687230.5

(51) Int. Cl.

| | |
|---|---|
| ***H01Q 5/335*** | (2015.01) |
| ***H01Q 1/10*** | (2006.01) |
| ***H01Q 1/24*** | (2006.01) |
| ***H01Q 21/28*** | (2006.01) |
| ***H01Q 1/00*** | (2006.01) |
| ***H01Q 1/32*** | (2006.01) |
| ***H01Q 21/24*** | (2006.01) |

(52) U.S. Cl.

CPC ..... *H01Q 21/28* (2013.01); *H01Q 1/007* (2013.01); *H01Q 1/10* (2013.01); *H01Q 1/247* (2013.01); *H01Q 1/3275* (2013.01); *H01Q 5/335* (2015.01); *H01Q 21/24* (2013.01)

(58) Field of Classification Search

CPC ..... H01Q 1/007; H01Q 1/3275; H01Q 21/28

See application file for complete search history.

(56) References Cited

U.S. PATENT DOCUMENTS

2016/0191693 A1* 6/2016 Zavala ..... H01Q 21/24 455/557

2017/0133764 A1* 5/2017 Tinaphong ..... H01Q 1/2291

FOREIGN PATENT DOCUMENTS

CN 105281049 A * 1/2016

* cited by examiner

*Primary Examiner* — Robert Karacsony

(74) *Attorney, Agent, or Firm* — Muncy, Geissler, Olds & Lowe, P.C.

(57) ABSTRACT

The present invention discloses a signal integrated terminal, comprising at least a housing, an antenna module and a circuit module, wherein the antenna module comprises a first antenna for receiving TV signals and second antennas for receiving and transmitting wireless signals, which are both matched with the housing and respectively electrically connected with the circuit module, and the circuit module is arranged in the housing. The present invention comprises two antenna types which can cover the common household antenna types to meet the use of common terminals nowadays, the two types of antennas are integrated in one device, so that the user can reduce the purchase cost without buying and installing different devices separately, besides, the user only needs to repair and maintain one device, namely the integrating terminal, which reduces the operating complexity. Particularly, when it is used on a moving traffic vehicle, such as automobile, ship or plane, it can save a big space for installation and reduce the wiring.

4 Claims, 3 Drawing Sheets

SIGNAL INTEGRATED TERMINAL

TECHNICAL FIELD

The present invention relates to the field of smart home, in particular to a signal integrated terminal.

BACKGROUND

With the rapid social development, the level of people's economic life is increasingly improved, the household appliances in households and office environment are increasing, people's operation of household appliances also becomes more and more complicated, besides, owing to the different operating manners of various household appliances, it requires for certain learning costs and purchase costs, and it causes inconvenience for people's life. At the same time, many household appliances, such as doorbell, TV signal receiver, router, etc., shall be placed in a clear space easy to been seen to affect the overall aesthetic appearance of the house. Further, it is inconvenient to use them separately, particularly that the TV signal receiver and the router have more line connections including at least signal lines and power lines, moreover, the TV signal receiver and the router is generally placed together with a TV set and a computer, respectively, such areas have complex lines, resulting in quite inconvenience in repair and maintenance of the TV signal receiver and the router.

SUMMARY

In order to overcome the problems of the prior art, the present invention provides a signal integrated terminal capable of simultaneously integrating wireless communication with TV signal receiving, at least comprising a housing, an antenna module and a circuit module, wherein the antenna module comprises a first antenna for receiving TV signals and a second antenna for receiving and transmitting wireless signals, which are both matched with the housing and respectively electrically connected with the circuit module arranged in the housing.

The present invention comprises two antenna types which can cover the common household antenna types to meet the use of common terminals nowadays. The two types of antennas are integrated in one device, so that the user can reduce the purchase cost without buying and installing different devices separately, besides, the user only needs to repair and maintain one device, namely the integrating terminal, which reduces the operating complexity. Particularly, when it is used on a moving traffic vehicle, such as automobile, ship or plane, it can save a big space for installation and reduce the wiring.

Further, the polarities of the first antenna and the second antennas are mutually orthogonal.

Since multiple different antennas are integrated in the same housing, the working frequencies of the first antenna (with the frequency band of TV signals of 88 MHz-230 MHz and 470 MH-700 MHz) and the second antennas (the wireless signals are generally WiFi signals, of which the frequency band is 2412 MHz-2483 MHz) range from dozens of MHz to thousands of MHz, therefore the anti-interference design in radio frequency is especially important. The crucial problem to be solved is to avoid the mutual interference among different signals, and thus, the polarities of the antennas are mutually orthogonal and the radiation charts of the antennas are in cross distribution, which avoids the mutual interference among the antennas.

Further, the circuit module comprises a TV signal module electrically connected with the first antenna, used for receiving TV signals, and a wireless communication module electrically connected with the second antennas, used for receiving and transmitting wireless signals.

The wireless communication module is configured to realize the function equivalent to a wireless router, and it can both realize the relaying function and transmit wireless signals as an access point.

Further, the wireless communication module is a wireless router or a repeater.

Further, the terminal also comprises a signal conversion module electrically connected with the TV signal module, used for converting the received TV signals into WiFi signals. In this way, when the TV signal module receives TV signals from the second antenna, the TV signals can also be transmitted by the wireless communication module to the user terminals, such as computer, mobile phone, tablet PC, etc., so that it will be more convenient for users to watch TV to improve the user experience.

Further, TV signal module comprises a resolution adjusting module electrically connected with the signal conversion module, used for adjusting the resolution of the TV signals according to the code rates of the signals and the different terminals wirelessly communicated with the signal conversion module.

Since the wireless signals have different code rates, when the wireless signal has a slower code rate, that is, the wireless signal has a slower transmission speed, it is necessary to reduce the data size of the TV signals by compressing the resolution, for convenience of the users to watch the videos fluently. Besides, the user terminals, such as tablet PC, computer, mobile phone, etc., have different screen sizes and can adapt to different resolutions, therefor, according to the present invention, the resolution can be adaptively adjusted according to the models of different terminals, at least it will not result in the phenomena of incomplete image display and black edging, etc., and it is favorable for improving the user experience in watching.

Further, the TV signal module also comprises a format conversion module electrically connected with the signal conversion module, used for converting different TV signal formats into the same format.

Since there are different TV video formats in various regions and the TV signals may have the formats of MP4, H.264, etc., the format conversion module is configured to convert different video formats into the same format for convenience of uniform coding and packaging into WiFi signals.

Further, the second antenna are flexible patch antennas.

Further, the first antenna comprises a VHF antenna for receiving VHF signals and a UHF antenna for receiving UHF signals, which are both electrically connected with the TV signal module.

Further, the TV signal module comprises a multi-level mixed trap circuit electrically connected with the UHF antenna and used for inhibiting the signals lower than 470 MHz.

Since the UHF may receive signals of other frequency bands, it is necessary to inhibit the signal frequencies except the frequency bands of TV signals, so as to acquire more accurate TV signals and reduce the interference.

Further, the TV signal module comprises an LTE filter electrically connected with the UHF antenna and used for inhibiting signals from mobile phones. Since the UHF may receive signals from mobile phones, it is necessary to inhibit the signal frequencies except the frequency bands of TV signals, so as to acquire more accurate TV signals and reduce the interference.

Further, the VHF antenna are telescopic antennas arranged outside the housing. The telescopic antennas have the advantages that they can rotate t freely and may allow to align with the optimal receiving direction while watching.

Further, the UHF antenna is a flake vibrator arranged inside the housing. The flake vibrator with light weight occupying a small space can reduce the space occupied in the housing.

Compared with the prior art, the utility model has desirable advantages that multiple antennas for receiving different wireless signals are integrated in the same device, on one hand, it can simultaneously realize the functions of receiving TV signals, transmitting and receiving wireless signals, etc.; on the other hand, it is unnecessary for the user to buy multiple different devices and arrange wires, respectively, accordingly, it greatly improves the convenience in use and maintenance. The integrating terminal also arranges the antennas reasonably to maximally reduce the interference among their signals and improve the effect of heat radiation, and its weight is reduced as much as possible for convenience of carrying and use.

DETAILED DESCRIPTION

The present invention will be explained in details combining with the specific embodiments and drawings below.

Figure 1:
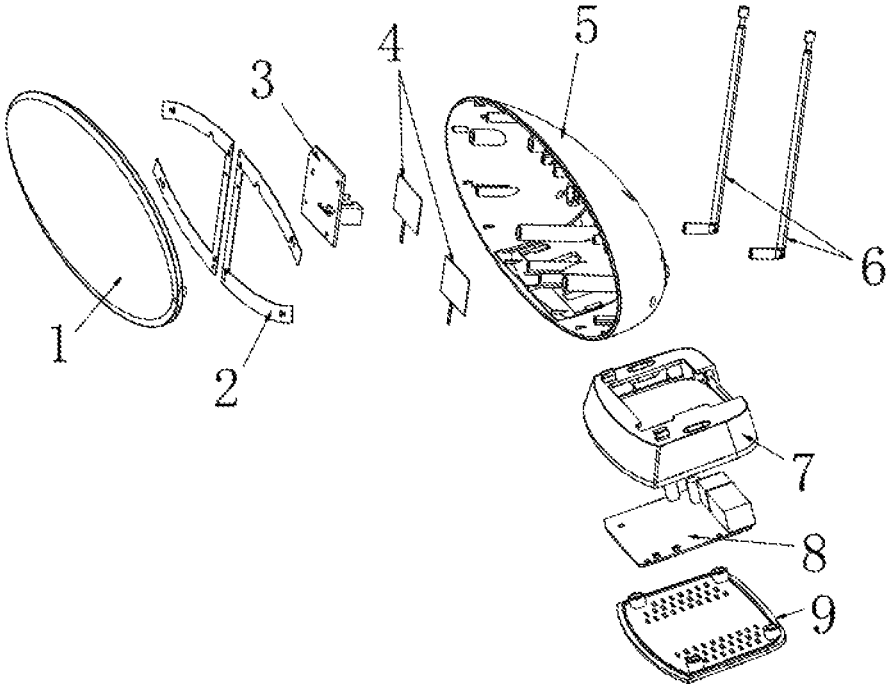
FIG. 1 is an explosive view of an embodiment according to the present invention.
Figure 2:
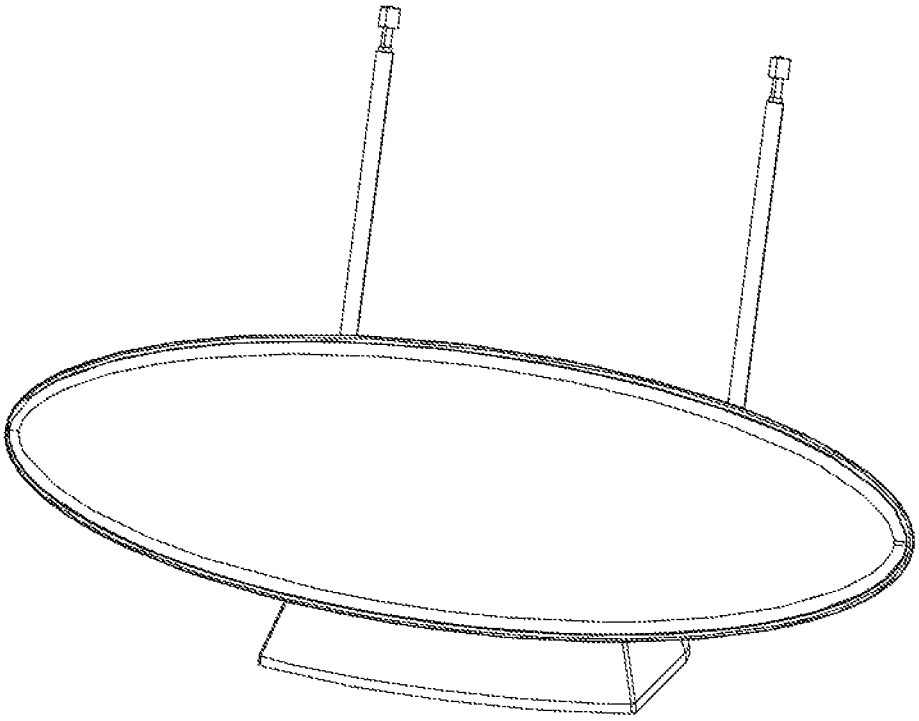
FIG. 2 is a perspective view of the embodiment.

A signal integrated terminal as shown in FIG. 1 and FIG. 2 at least comprises a housing, an antenna module including a first antenna for receiving TV signals and a second antenna 4 for receiving and transmitting WiFi signals, which are both matched with the housing, and a circuit module arranged in the housing, and the polarities of the first antenna and the second antennas 4 are mutually orthogonal in space, and they are electrically connected with the circuit module.

Preferably the second antenna 4 are two flexible patch antennas.

The first antenna preferably comprises a VHF antenna 6 for receiving VHF signals and a UHF antenna 2 for receiving UHF signals. The VHF antenna 6 are two telescopic antennas arranged at the rear end of outside of the housing. The telescopic antennas have the advantages that they can rotate freely and allow to align with the optimal receiving direction while watching. The UHF antenna 2 is an annular flake vibrator, as the flake vibrator with light weight occupying a small space can reduce the space occupied in the housing.

The housing is formed by a front shell 1 and a rear shell 5 by buckling, particularly, the UHF antenna 2 and the second antenna 4 are installed in the housing from front to back, the two flexible patch antennas are at a distance of 210 mm and are in bilateral symmetry, and the VHF antennas 6 are arranged outside the rear shell 5.

The second antennas 4 are preferably kept at a distance of more than 5 cm from the VHF antennas 6 and the UHF antenna 2, respectively, ensuring to occupy a less space, and at the same time making the signal interference among the antennas reduce to a suitable level.

The circuit module comprises a TV signal module 3 electrically connected with the VHF antenna 6 and the UHF antenna 2 and used for receiving TV signals, and it is specifically installed between the front shell 1 and the rear shell 5, and a wireless communication module 8 electrically connected with the second antenna 4 and used for receiving and transmitting WiFi signals.

Actually, the wireless communication module 8 can be a wireless router or repeater, and a Qualcomm chip or MTK chip can be adopted, with the power of transmitting WiFi signals up to 25 dBm and the receiving sensitivity up to −105 dBm; at the same time, the second antenna in form of omnibearing antennas of 5 dBi can effectively enlarge the wireless coverage to realize the functions of repeat, etc. The wireless router can also be set as the intermittent service of 50 ms for standby, and the transmission power can be adjusted according to the user's downlink network transmission rate for reduction of power consumption, energy saving and environmental protection.

The housing further comprises a bottom shell including an upper box 7 and a lower cover 9, specifically the upper box 7 is matched with the front shell 1 and the rear shell 5 and arranged at the bottom thereof. The lower cover 9 is matched with the upper box 7 to install the wireless communication module 8 between them.

The TV signal module 3 comprises a multi-level mixed trap circuit electrically connected with the UHF antenna 2 and used for inhibiting the signals lower than 470 MHz. Since the UHF antenna 2 may receive signals of other frequency bands, it is necessary to inhibit the signal frequencies except the frequency bands of TV signals, and the degree of inhibition is actually up to 40 dB. The TV signal module 3 further comprises an LTE filter electrically connected with the UHF antenna 2 and used for inhibiting signals from mobile phones. Since the UHF antenna 2 may receive signals from mobile phones, it is necessary to inhibit the signal frequencies except the frequency bands of TV signals, the filtering depth of 700 MHz to 710 MHz can actually reach to 20 dB.

Figure 3:
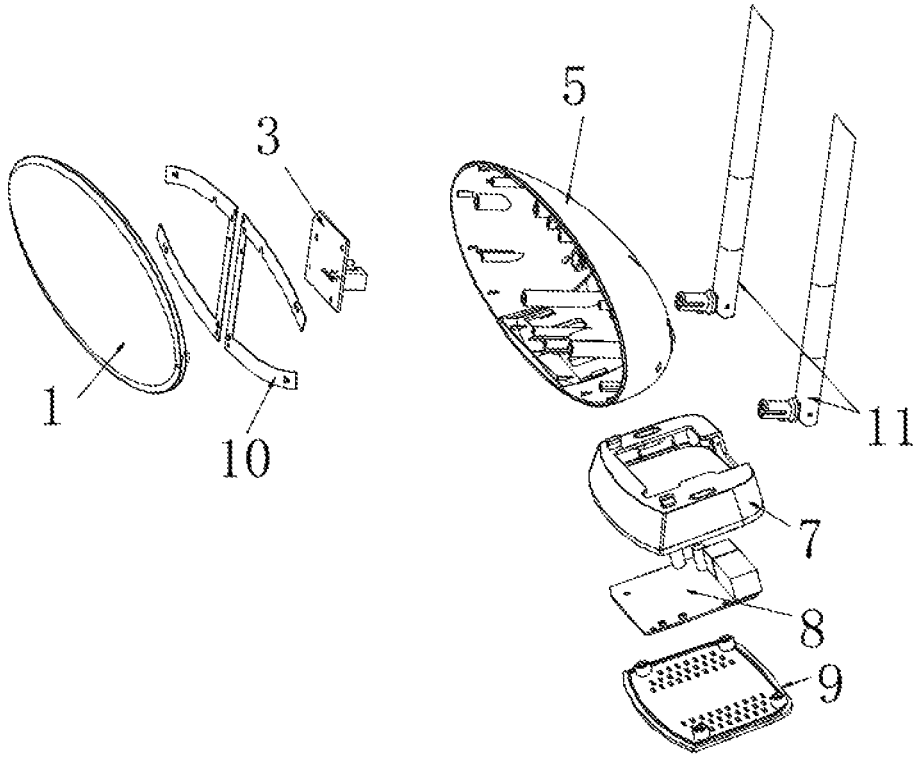
FIG. 3 is an explosive view of another embodiment according to the present invention.

In another embodiment of the present invention, ss shown in FIG. 3, the first antenna 10 is an annular flake vibrator arranged between the front shell 1 and the rear shell 5 and electrically connected with the TV signal module 3. The second antenna 11 are two telescopic antennas arranged at the rear end of outside of the rear shell 5 and electrically connected with the wireless communication module 8.

Figure 4:
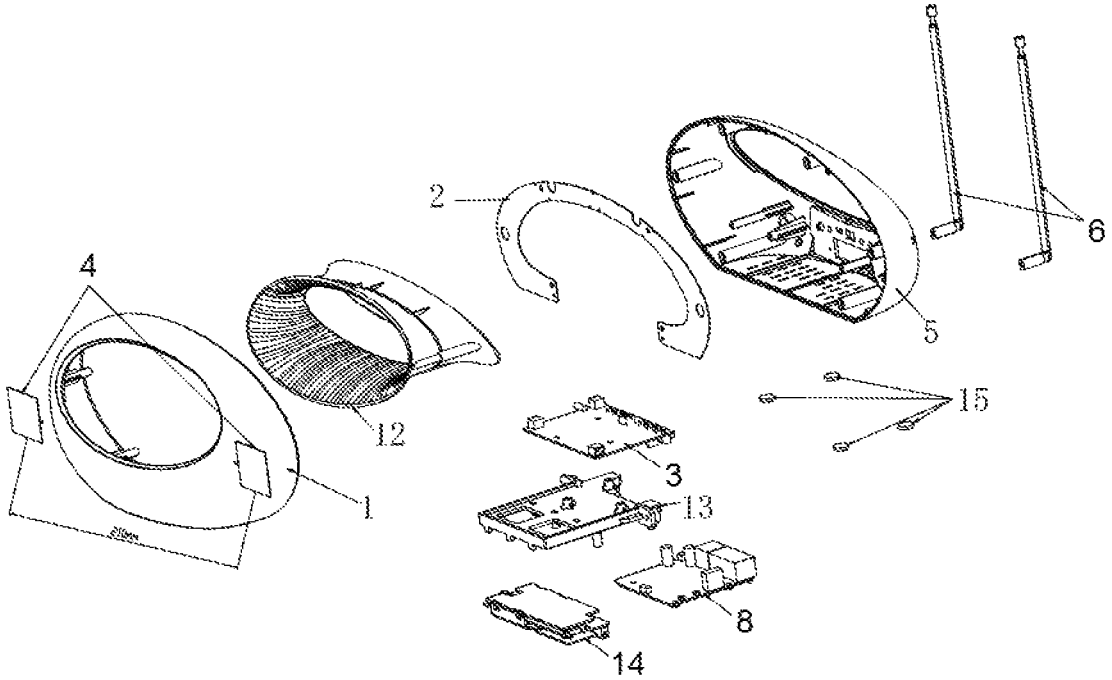
FIG. 4 is an explosive view of another embodiment according to the present invention.

FIG. 4 illustrates another preferable embodiment of the present invention comprising a housing, an antenna module including a first antenna for receiving TV signals and a second antenna 4 for receiving and transmitting WiFi signals, which are both matched with the housing, and a circuit module arranged in the housing, and the polarities of the first antenna and the second antennas 4 are mutually orthogonal in space, and they are electrically connected with the circuit module.

Preferably the second antennas 4 are two flexible patch antennas.

The first antenna comprises a VHF antenna 6 for receiving VHF signals and a UHF antenna 2 for receiving UHF signals which are electrically connected with the TV signal module 3. The VHF antenna 6 are two telescopic antennas arranged at the rear end of outside of the housing. The telescopic antennas have the advantages that they can rotate freely and can allow to align with the optimal receiving direction while watching. The UHF antenna 2 is an annular flake vibrator, as the flake vibrator with light weight occupying a small space can reduce the space occupied in the housing.

The housing is formed by a front shell 1, a fixed ring 12 and a rear shell 5 by buckling, particularly, the annular UHF antenna 2 is installed on the fixed ring 12, four gaskets 15 for convenience of placing are uniformed arranged at the bottom of the housing, the two flexible patch antennas are arranged on the front shell 1 at a distance of 210 mm and in bilateral symmetry, and the VHF antenna 6 are arranged outside the rear shell.

The second antenna 4 are kept at a distance of more than 5 cm from the VHF antenna 6 and the UHF antenna 2, respectfully, ensuring to occupy a less space, and at the same time making the signal interference among the antennas reduce to a suitable range.

The circuit module comprises a TV signal module 3 electrically connected with the VHF antenna 6 and the UHF antenna 2 and used for receiving TV signals, and a wireless communication module 8 electrically connected with the second antenna and used for receiving and transmitting WiFi signals.

Specifically, the wireless communication module 8 can be a wireless router or repeater, and a Qualcomm chip or MTK chip can be adopted, with the power of transmitting WiFi signals up to 25 dBm and the receiving sensitivity up to −105 dBm; at the same time, the second antenna 4 in form of omnibearing antennas of 5 dBi can effectively enlarge the wireless coverage to realize the functions of repeat, etc. The wireless router can also be set as the intermittent service of 50 ms for standby, and the transmission power can be adjusted according to the user's downlink network transmission rate for reduction of power consumption, energy saving and environmental protection.

The terminal further comprises a signal conversion module 14 electrically connected with the TV signal module 3 and used for converting the received TV signals into WiFi signals.

The TV signal module 3, the wireless communication module 8 and the signal conversion module 14 are installed at the bottom of the housing through a fixed mount 13, particularly the heavier signal conversion module 14 and wireless communication module 8 are installed at the lower part of the fixed mount 13, whereas the lighter TV signal module 3 is installed at its upper part, so that the center gravity of the terminal is lower for convenience of placing.

The TV signal module 3 comprises a multi-level mixed trap circuit connected with the UHF antenna 2 and used for inhibiting the signals lower than 470 MHz. Since the UHF antenna 2 may receive doorbell signals of lower frequency band, it is necessary to inhibit the signal frequencies except the frequency bands of TV signals, and the degree of inhibition is actually up to 40 dB. The TV signal module 3 further comprises an LTE filter electrically connected with the UHF antenna 2 and used for inhibiting signals from mobile phones. Since the UHF antenna 2 may receive signals from mobile phones, it is necessary to inhibit the signal frequencies except the frequency bands of TV signals, the filtering depth can actually reach to 20 dB.

In practice, the housing is also provided with a learning key electrically connected with the doorbell receiver and used for adjusting the codes in the doorbell receiver, so that it can adopt to different doorbell signals, and the doorbell receiver operates intermittently for the reduction of standby power consumption, energy saving and environmental protection.

The TV signal module 3 also comprises a resolution adjusting module and a format conversion module which are electrically connected with the wireless communication module 8, respectively. Since there are different TV video formats in various regions, such as MP4, H.264, etc., the format conversion module is configured to convert different video formats into H.264 format for convenience of uniform coding and packaging into WiFi signals to transmit to the wireless communication module 10.

The resolution adjusting module will obtain the user's network conditions and screen information according to different network sites and adjusts the resolution aiming at different terminals of the user, so that the user can smoothly play videos under different wireless environment to enhance the user experience. The adjustment relation of different terminal screen sizes, pixel densities and resolutions are as shown in the table below.

| Screen Size (inch) | Pixel Density (PPI) | Resolution |
|---|---|---|
| 2.8 | 286 | 640 × 480 |
| 3.2 | 167 | 480 × 320 |
| 3.3 | 297 | 854 × 480 |
| 3.5 | 165 | 480 × 320 |
| 3.5 | 267 | 800 × 480 |
| 3.5 | 280 | 854 × 480 |
| 3.5 | 326 | 960 × 640 |
| 3.7 | 252 | 800 × 480 |
| 3.7 | 298 | 960 × 540 |
| 4.0 | 233 | 800 × 480 |
| 4.0 | 245 | 854 × 480 |
| 4.0 | 275 | 960 × 540 |
| 4.0 | 330 | 1136 × 640 |
| 4.2 | 262 | 960 × 540 |
| 4.3 | 217 | 800 × 480 |
| 4.3 | 268 | 960 × 640 |
| 4.3 | 256 | 960 × 540 |
| 4.3 | 342 | 1280 × 720 |
| 4.5 | 245 | 960 × 540 |
| 4.5 | 326 | 1280 × 720 |
| 4.5 | 490 | 1920 × 1080 |
| 4.7 | 490 | 1920 × 1080 |
| 4.8 | 306 | 1280 × 720 |
| 5.0 | 186 | 480 × 800 |
| 5.0 | 256 | 1024 × 768 |
| 5.0 | 294 | 1280 × 720 |
| 5.0 | 207 | 1920 × 1080 |
| 5.3 | 285 | 1280 × 800 |
| 5.3 | 207 | 960 × 540 |
| 6.0 | 163 | 854 × 480 |
| 6.0 | 245 | 1280 × 720 |
| 6.0 | 498 | 2560 × 1600 |
| 7.0 | 128 | 800 × 480 |
| 7.0 | 169 | 1024 × 600 |
| 7.0 | 216 | 1280 × 800 |
| 9.7 | 132 | 1024 × 768 |
| 9.7 | 264 | 2048 × 1536 |
| 10 | 170 | 1200 × 600 |
| 10 | 299 | 2560 × 1600 |

Figure 5:
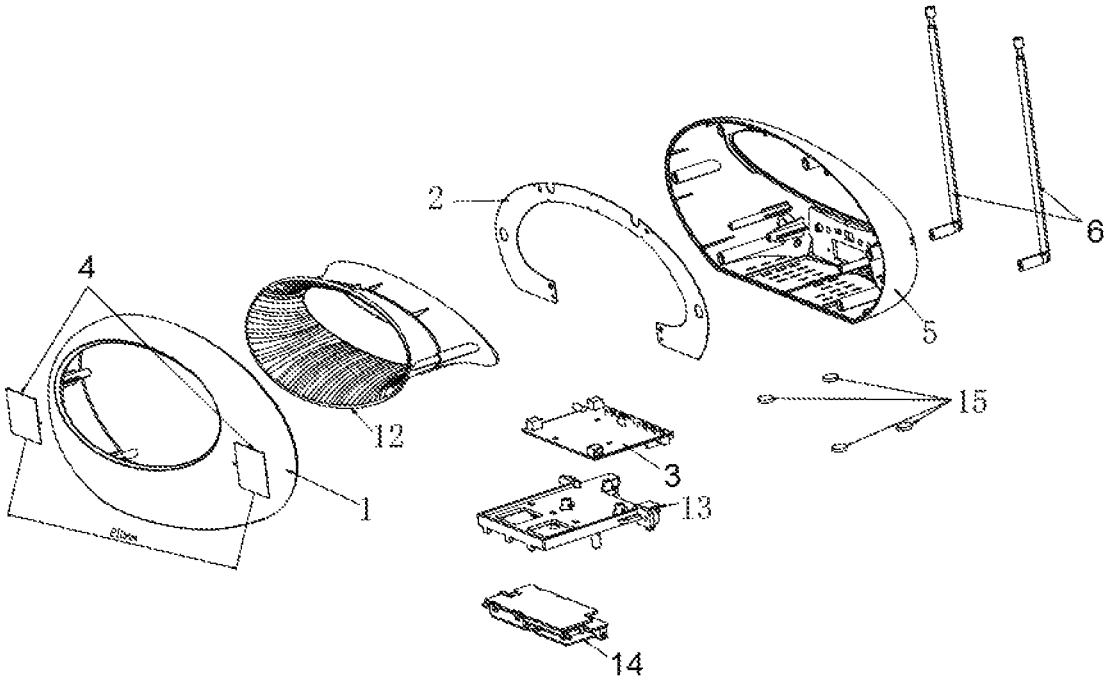
FIG. 5 is an explosive view of another embodiment according to the present invention.

In another preferable embodiment, as shown in FIG. 5, a wireless communication module 8 is not configured, and the signal conversion module 14 is electrically connected with the second antenna 4.

What is claimed is:

1. A signal integrated terminal, at least comprising:

a housing;

an antenna module comprising a first antenna for receiving TV signals and a second antenna for receiving and transmitting wireless signals, which are both matched with the housing, the first antenna comprising a UHF antenna, the UHF antenna being a flake vibrator arranged inside the housing, the second antenna being designed as two flexible patch antennas; and a circuit module arranged in the housing and electrically connected with the first antenna and the second antennas, the circuit module comprising a TV signal module electrically connected with the first antenna, used for receiving TV signals, the TV signal module comprising:

a multi-level mixed trap circuit electrically connected with the UHF antenna and used for inhibiting the signals lower than 470 MHz; and an LTE filter electrically connected with the UHF antenna and used for inhibiting signals from mobile phones, wherein the polarities of the first antenna and the second antenna are mutually orthogonal.

2. The signal integrated terminal according to claim 1, wherein the circuit module further comprises:

a wireless communication module electrically connected with the second antennas, used for receiving and transmitting wireless signals.

3. The signal integrated terminal according to claim 2, wherein the wireless communication module is a wireless router or repeater.

4. The signal integrated terminal according to claim 2, wherein the first antenna further comprises a VHF antenna arranged at the rear end of outside of the housing, and wherein the VHF antenna and the UHF antenna are electrically connected with the TV signal module.

* * * * *